US009015889B1

(12) United States Patent
Khonsary

(10) Patent No.: US 9,015,889 B1
(45) Date of Patent: Apr. 28, 2015

(54) SNAKE TOOL ADAPTOR

(71) Applicant: Cyrus Khonsary, Morriston, FL (US)

(72) Inventor: Cyrus Khonsary, Morriston, FL (US)

( * ) Notice: Subject to any disclaimer, the term of this patent is extended or adjusted under 35 U.S.C. 154(b) by 0 days.

(21) Appl. No.: 14/287,042

(22) Filed: May 25, 2014

(51) Int. Cl.

| | |
|---|---|
| ***B08B 9/04*** | (2006.01) |
| ***E03F 9/00*** | (2006.01) |
| ***B08B 9/027*** | (2006.01) |
| *B08B 9/00* | (2006.01) |

(52) U.S. Cl.
CPC ..... *E03F 9/005* (2013.01); *B08B 9/027* (2013.01); *B08B 9/00* (2013.01)

(58) Field of Classification Search
CPC ..... B08B 9/00; B08B 9/027; B08B 9/043
USPC ..... 15/104.31, 104.33, 104.05, 104.095, 15/104.09
See application file for complete search history.

(56) References Cited

U.S. PATENT DOCUMENTS

| | | | | | |
|---|---|---|---|---|---|
| 1,510,212 | A * | 9/1924 | Du Bois | 15/104.31 |
| 2,044,848 | A * | 6/1936 | Hermanson | 24/134 R |
| 2,057,842 | A * | 10/1936 | Nielsen | 15/104.09 |
| 2,090,174 | A * | 8/1937 | Albright | 464/7 |
| 2,460,149 | A * | 1/1949 | Schoensiegel | 74/421 A |
| 3,397,420 | A * | 8/1968 | Schneider | 15/104.33 |
| 4,364,140 | A * | 12/1982 | Irwin | 15/104.33 |
| 5,035,796 | A * | 7/1991 | Saylor et al. | 210/198.1 |
| 5,107,550 | A * | 4/1992 | Hawro | 4/255.08 |
| 6,421,871 | B1 * | 7/2002 | Peach et al. | 15/104.33 |
| 8,397,335 | B2 * | 3/2013 | Gordin et al. | 15/104.05 |
| 8,434,185 | B1 * | 5/2013 | Beaver, Sr. | 15/104.05 |
| 8,510,891 | B2 * | 8/2013 | Fivecoate | 15/104.33 |
| 2007/0089254 | A1 * | 4/2007 | Alaine | 15/104.33 |
| 2014/0115802 | A1 * | 5/2014 | Yu | 15/104.33 |

* cited by examiner

*Primary Examiner* — Monica Carter
*Assistant Examiner* — Michael Jennings
(74) *Attorney, Agent, or Firm* — Massinger Law Offices

(57) ABSTRACT

A snake tool adaptor capable of coupling commercially available heavy duty drain cleaning cables and attachments normally associated with heavy electric drain cleaners with a portable rotary driving tool such as a hand-held drill. Adaptors of the subject invention include a hand grip having a proximal end terminating in a shank for operable attachment to a the chuck of a power drill, and a distal end terminating in coupling means for removable mating engagement with various heavy duty drain cleaning cables and their attachments normally associated with heavy electric drain cleaners.

5 Claims, 3 Drawing Sheets

SNAKE TOOL ADAPTOR

FIELD OF THE INVENTION

The subject invention relates to the field of drain cleaning generally, and to an adapter for snake cables to permit coupling to handheld rotary power drills in particular.

BACKGROUND OF THE INVENTION

The term "drain cleaner" as used herein refers to a mechanical device used to unblock pipes or drains. Such drain cleaners can be classified in two categories, according to their intended use; handheld drain cleaners and electric drain cleaners. If a single sink, toilet, or tub or shower drain is clogged the first choice is normally a drain cleaner that can remove soft obstructions such as hair and grease clogs that can accumulate close to interior drain openings. Handheld drain cleaners or "augers" are intended for this purpose. If more than one plumbing fixture is dogged the first choice is normally a drain cleaner that can remove soft or hard obstructions along the entire length of the drain, from the drain opening through the main sewer drain to the lateral piping outside the building. Electric drain cleaners are intended for this purpose.

Handheld drain augers are typically designed to clean portions of a drain within 25 feet (8 meters) of the drain opening. The cable of a handheld drain auger is driven into a drain by the mechanical force created when the operator rotates a drum that anchors the cable. Many handheld augers have cables that are thin enough to pass through common sink traps, but are typically only effective on smaller diameter pipes of ¾" to 2½" (19-64 mm). They are not well suited on larger drain and sewer pipes which can have diameters of 3" to 8" (75 mm to 200 mm).

By contrast, electric drain cleaners, also called "plumber's snakes", use the mechanical force of an electric motor to twist a flexible cable or spring in a clockwise direction and drive it into a pipe. Electric drain cleaners are commonly available with cable lengths ranging incrementally from 25 feet (7.6 m) up to 100 feet (30.5 m) or longer. Although drain cleaners of the electric rotary variety possess certain advantages including the ability to clean long sections of sewer drain and the ability to remove solid objects such as tree roots and jewelry from pipes, they suffer from a variety of shortcomings. For instance, electric drain cleaners are relatively expensive, considerably heavy and are attendant with several safety risks. It is not unusual for the electric drain cleaning machine alone (without accessories and attachments) to weigh in excess of 100 pounds and many models can weigh up to three times that much rendering them useless for jobs that require access by ladder such as when accessing rooftop vent stacks. Even so-called "lightweight" and highly portable models can weigh over 40 pounds without accessories, and over 90 pounds with accessories, requiring significant physical effort to carry.

In view of the common need for cleaning out larger drain and sewer pipes having diameters of 3" to 8", and still further considering the need to access those drains from rooftop vent stacks and other locations requiring ladder access, it is apparent that a need exists for a lightweight and portable drain cleaning apparatus possessing heavy duty use capabilities normally associated with heavy electric drain cleaners.

SUMMARY OF THE INVENTION

The subject invention meets the above-described need in the art by providing a snake tool adaptor capable of coupling commercially available heavy duty drain cleaning cables and attachments normally associated with heavy electric drain cleaners with a portable rotary driving tool such as a handheld drill. More specifically, the snake tool adaptor of the subject invention is includes a shaft, typically polygonal in cross section for operable attachment to a the chuck of a power drill, coupling means for removable mating engagement with various heavy duty drain cleaning cables and attachments normally associated with heavy electric drain cleaners, and an elongated gripping portion sized, shaped and textured to facilitate attachment of the adaptor to the rotary device and attachment of the cleaning cable to the adaptor, as well as handling of the cleaning cable during operation. The subject adaptor, therefore, provides a means for facilitating the cleaning out of larger drain and sewer pipes having diameters of 3" to 8" without the need for large, heavy and cumbersome electric drain cleaners.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a snake tool adaptor capable of operable attachment to a portable powered rotational drive device such as a handheld drill on one end, and to heavy duty drain cleaning cables and attachments normally associated with heavy electric drain cleaners on the other end.

It is another primary object of the subject invention to provide a snake tool adaptor which, in operable combination with a powered rotational drive device such as a drill and heavy duty drain cleaning cables and attachments, provides a drain cleaning apparatus for cleaning out larger drain and sewer pipes having diameters of 3" to 8" while being lightweight and portable enough for ladder carry.

Another object of the subject invention is to provide a snake tool adaptor having an elongated gripping portion sized, shaped and textured to facilitate attachment of the adaptor to the rotary device and attachment of the cleaning cable to the adaptor, as well as handling of the cleaning cable during operation.

Still another object of the subject invention is to provide a snake tool adaptor which is relatively simple in design and therefore capable of rapid construction at relatively low costs.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
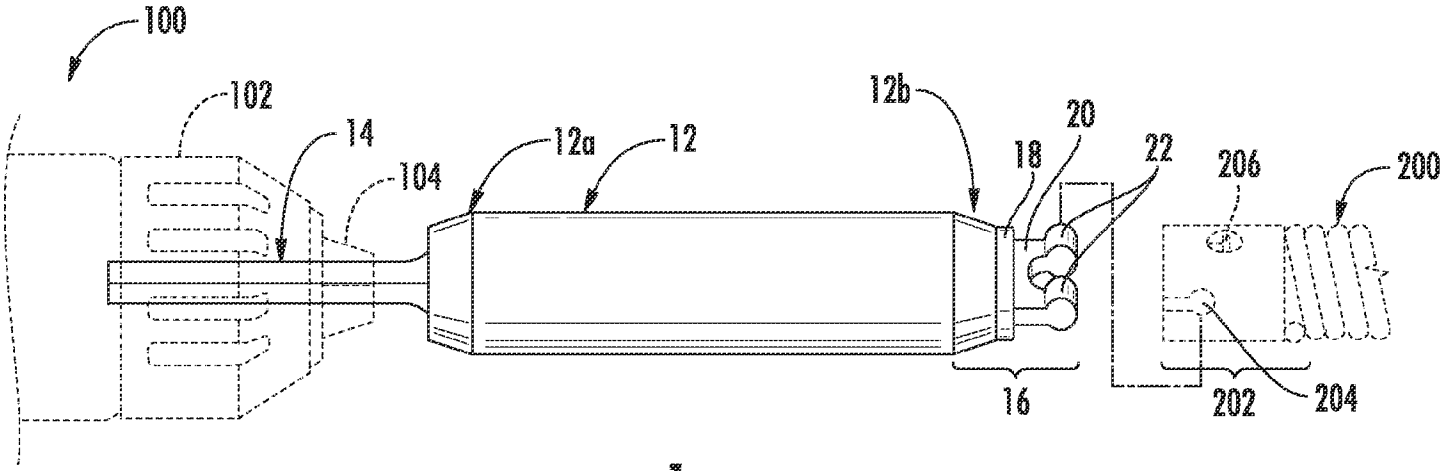
FIG. 1 is a perspective view of a first embodiment of the subject snake tool adaptor shown in relation to a heavy duty cable with conventional corresponding female coupler.
Figure 2:
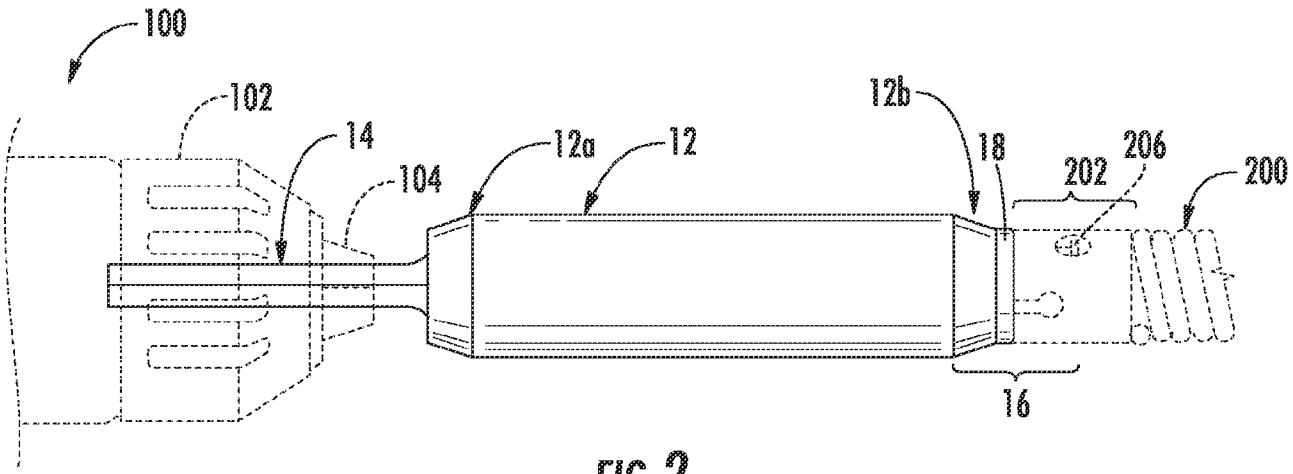
FIG. 2 is a perspective view of the snake tool adaptor of FIG. 1 shown coupled to the heavy duty cable.
Figure 3:
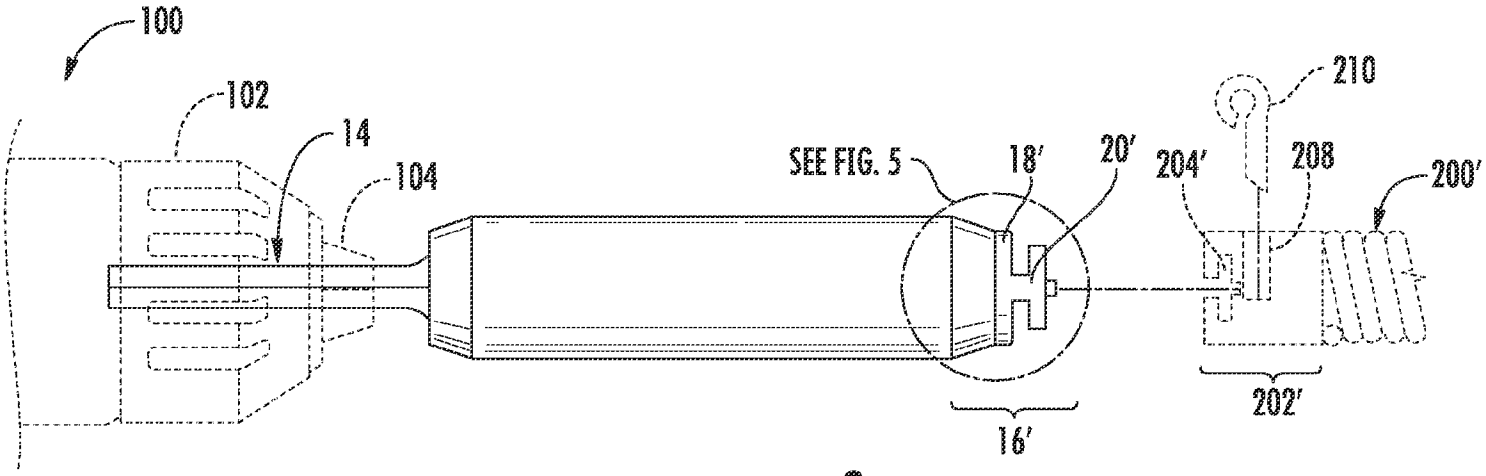
FIG. 3 is a perspective view of an alternate embodiment of the subject snake tool adaptor shown in relation to a heavy duty cable with conventional corresponding female coupler.
Figure 4:
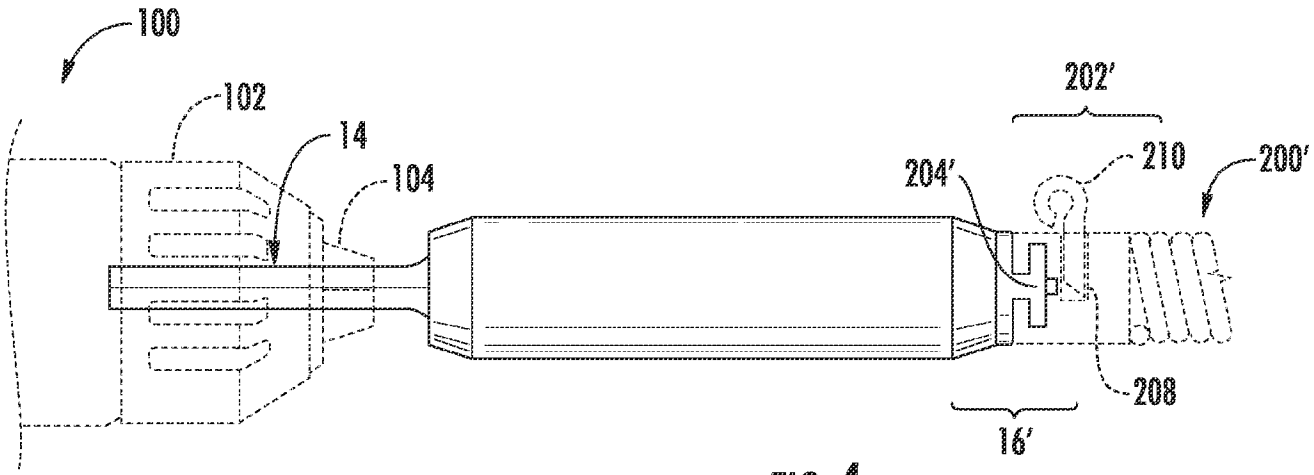
FIG. 4 is a plan view of the snake tool adaptor of FIG. 3 shown coupled to the heavy duty cable.

Reference is now made to FIGS. 1 and 2 in which there is illustrated a first preferred embodiment of the subject snake tool adaptor (hereinafter sometimes also referred to as simply "adaptor"), designated generally by reference numeral 10. Adaptor 10 includes three primary components, namely a grip 12 having a first end 12*a* terminating in a shank 14, and a second end 12*b* terminating in cable coupler 16. In one embodiment, shank 14, grip 12 and coupler 16 are integrally formed together to be of unibody construction such as may be accomplished through forging, casting or machining of a metal or metal alloy. Alternately, these components may be injection molded from thermoplastic or thermosetting polymers ("plastics").

Shank 14 is preferably but not essentially polygonal in cross section, and sized for operable attachment to a portable hand-held power drill 100, and more particularly within the chuck 102 thereof. Drill 100 may be of the corded or cordless variety. Chuck 102 may be any clamp used to hold a rotating work piece having radial symmetry, especially a cylindrical work piece such as a drill bit. For example, chuck 102 may include a plurality of jaws 104 which are dogs arranged in a radially symmetrical pattern to hold the shaft 14 of adaptor 10. Jaws 104 may be tightened or loosened with the help of a chuck key (not shown) or chuck 102 may be of the keyless variety such that the tightening and loosening of jaws 104 is accomplished by hand force alone. Chuck 102 may be of any other variety suitable for holding shank 14 firmly in place for rotary work, including collet chucks, magnetic chucks, vacuum chucks and the like. Neither drill 100, nor chuck 102 is considered components of the subject adaptor.

Grip 12 is an elongated shaft radially symmetrical in cross-section having a length of approximately 3.5" to 4.5" and a diameter of approximately ¾" to 1¼". Grip 12 may have a variety of cross-sectional shapes including, but not limited to, circular and polygonal. In one embodiment, grip 12 has a cross-sectional shape of a Reuleaux triangle, but with more smooth and tapered apexes. Grip 12 is preferably but not essentially solid. In one embodiment, grip 12 or a portion thereof has a smooth polished surface. In other embodiments, the outer surface of grip 12, or portions thereof, is textured to provide greater friction when grasped. Grip 12 is an important feature of the subject adaptor 10 because it provides a gripping surface for the user's hand to facilitate attachment of adaptor 10 to a hand-held drill and to a drain cleaning cable. When adaptor 10 is connected only to the cable (i.e., not to the drill), grip 12 serves as a handle to facilitate manipulation of the cable during use.

Adaptor 10 further includes various coupling means, opposite shaft 12, for removable mating engagement with various heavy duty drain cleaning cables 200 and their attachments. Coupling means may be of any design and construction capable of securely mating with the non-working end of a heavy duty drain cleaning cable, namely those intended for use in combination with electric drain cleaners. It should be noted that the coupling means may also be suitable for use with cables associated with hand-held drain cleaners ("augers") as previously described.

With continued reference to FIGS. 1 and 2, a first embodiment of a coupling means is depicted, namely coupler 16. Coupler 16 is adapted for mating engagement with a heavy duty cable 200 having a RIDGID® brand female quick-connect coupling 202, manufactured by Ridge Tool Company, attached to its proximal end. Female coupling 202 includes a generally i-shaped (in cross-section) channel 204 disposed transversely through its distal end for slidably receiving a similarly shaped male member of coupler 16. Coupler 16 includes a disc-shaped base 18 having a first side fixedly attached to, or integrally formed with, the second end 12*b* of grip 12. The male member of coupler 16 is comprised of a c-shaped transverse member 20 projecting normal to the opposite side of base 18, the transverse member 20 terminating at each end of its c-shape in concentrically aligned cylinders 22. As will be appreciated by those skilled in the art, transverse member 20 and cylinders 22 are slidably received in channel 204 of female coupling 202 and locked into place by causing the distal end (not shown) of a slotted pin 206 to be disposed between cylinders 22 thus preventing their axial movement. This is accomplished by rotating slotted pin 206 approximately 90 degrees using a flat head screwdriver or other suitable tool.

Figure 5:
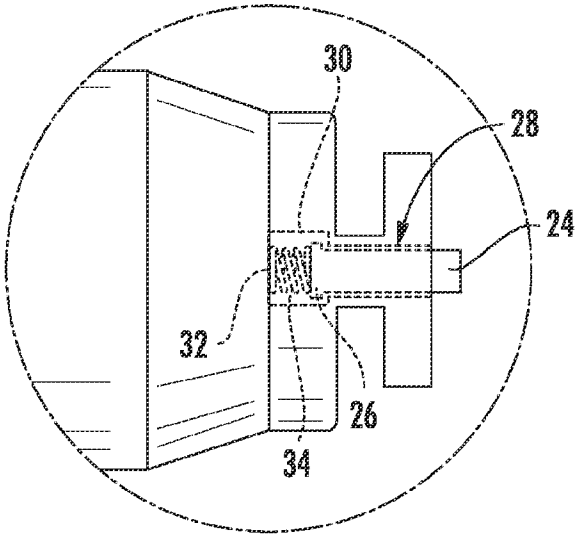
FIG. 5 is an enlarged view of the coupling end of the snake tool adaptor of FIG. 3 portions of which are shown in ghost view to illustrate the internal components thereof.
Figure 6:
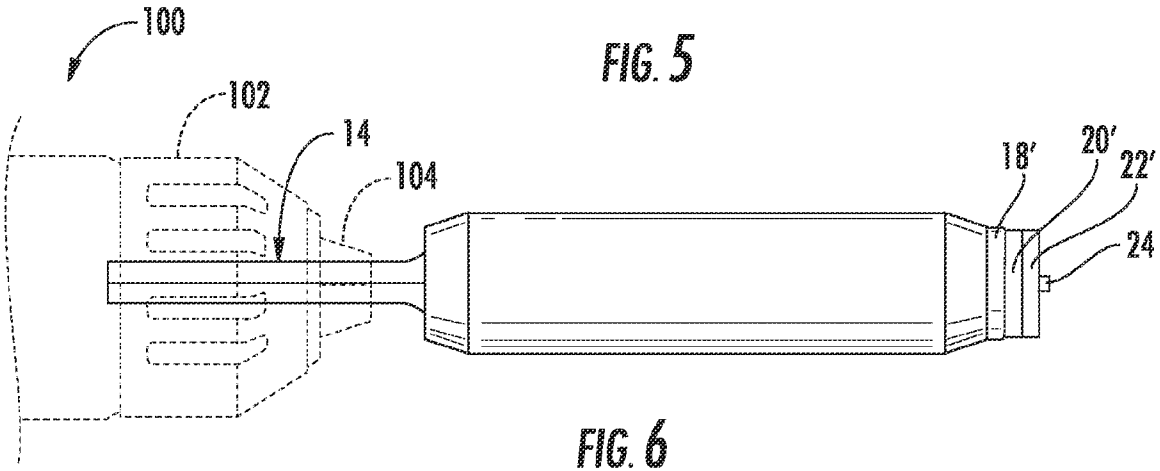
FIG. 6 is a side view of the snake tool adaptor of FIG. 3.

Referring now to FIGS. 3 through 6, a second embodiment of a coupling means is depicted, namely coupler 16'. Coupler 16' is adapted for mating engagement with a heavy duty cable 200' having a RIDGID® brand female K-10 quick-connect coupling 202', manufactured by Ridge Tool Company, attached to its proximal end. Female K-10 coupling 202' includes a generally t-shaped (in cross-section) channel 204' disposed transversely through its distal end for slidably receiving a similarly shaped male member of coupler 16'. Male coupler 16' is similar or identical in design to the RIDGID® brand male K-10 quick-connect coupling manufactured by Ridge Tool Company and includes a disc-shaped base 18' having a first side fixedly attached to, or integrally formed with, the second end 12*b'* of grip 12'. The male member of coupler 16' is comprised of a T-shaped transverse member 20' projecting normal to the opposite side of base 18'. Transverse member 20' includes an axial channel 28 disposed therethrough and in communication with concentrically aligned chamber 30 disposed within base 18' as best seen in FIG. 5. Chamber 30 is diametrically greater than axial channel 28. A pin 24 having an annular flange 26 at its proximal end is slidably disposed within axial channel 28 and retained therein by flange 26 which occupies a portion of chamber 30. A helical spring 34 or other elastic device capable of exerting a force on pin 24 when compressed is housed within chamber 30 and biased between the proximal end of pin 24 and/or flange 26 and opposing rear wall 32 of chamber 30. A distal end portion of pin 24 normally protrudes from transverse member 20' giving it its t-shape and as may be readily appreciated by those skilled in the art serves to lock the male member of coupler 16' within the channel 204' of female K-10 quick-connect coupling 202'. A coupling pin key 210 may be inserted into bore 208 which is in communication with channel 204' to depress pin 24 for subsequent separation of the aforesaid male and female coupling components.

Each of the above-described embodiments of the subject snake tool adaptor, therefore, when used in combination with commercially available heavy-duty drain cleaning cables and a hand-held drill, provides a means for facilitating the cleaning out of larger drain and sewer pipes having diameters of 3" to 8" without the need for large, heavy and cumbersome electric drain cleaners. Accordingly, the subject adaptors facilitate the cleaning of pipes having rooftop vent stacks, especially those that can only be accessed by ladder.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A snake tool adaptor for coupling a heavy-duty drain cleaning cable with a portable rotary driving tool such as a hand-held drill, the adaptor comprising a radially symmetrical hand grip approximately 3.5 inches to 5.5 inches in length and having a proximal end terminating in a shank for operable attachment to a power drill, and a distal end terminating in coupling means for removable mating engagement with a heavy-duty drain cleaning cable, said coupling means being comprised of a coupler having a design and construction capable of securely mating with the non-working end of a heavy duty drain cleaning cable, said coupler being comprised of a disc-shaped base having a first side fixedly attached to, or integrally formed with, said distal end of said grip, a T-shaped transverse member projecting normal to said base and having an channel disposed axially therethrough and in communication with a concentrically aligned chamber disposed within said base, a pin having an annular flange at one end, said pin being slidably disposed within said axial channel and retained therein by said flange, and biasing means within said chamber for exerting a force on said pin.

2. A snake tool adaptor for coupling a heavy-duty drain cleaning cable with a portable rotary driving tool such as a hand-held drill, the adaptor comprising a hand grip having a proximal end terminating in a shank for operable attachment to a power drill, and a distal end terminating in a coupler for removable mating engagement with a heavy-duty drain cleaning cable, said coupler comprising a disc-shaped base having a first side fixedly attached to, or integrally formed with, said distal end of said grip, a T-shaped transverse member projecting normal to said base and having an channel disposed axially therethrough and in communication with a concentrically aligned chamber disposed within said base, a pin having an annular flange at one end, said pin being slidably disposed within said axial channel and retained therein by said flange, and biasing means within said chamber for exerting a force on said pin.

3. The snake tool adaptor of claim 2, wherein said hand grip is radially symmetrical.

4. The snake tool adaptor of claim 2, wherein said hand grip has a length of approximately 3.5 inches to 4.5 inches.

5. The snake tool adaptor of claim 2, wherein said hand grip is radially symmetrical and has a length of approximately 3.5 inches to 4.5 inches.

* * * * *